United States Patent [19]

Aoyama

[11] 4,048,968

[45] Sept. 20, 1977

[54] EXHAUST GAS RECIRCULATION SYSTEM

[75] Inventor: Syuniti Aoyama, Yokohama, Japan

[73] Assignee: Nissan Motor Company, Limited, Yokohama, Japan

[21] Appl. No.: 705,436

[22] Filed: July 15, 1976

[30] Foreign Application Priority Data

July 17, 1975 Japan ..... 50-99314[U]

[51] Int. Cl.[2] ..... F02M 25/06

[52] U.S. Cl. ..... 123/119 A

[58] Field of Search ..... 123/119 A; 60/278, 279

[56] References Cited

U.S. PATENT DOCUMENTS

| | | | |
|---|---|---|---|
| 3,380,245 | 4/1968 | Mick | 123/119 A |
| 3,802,402 | 4/1974 | Swatman | 123/119 A |
| 3,834,363 | 9/1974 | Goto et al. | 123/119 A |
| 3,868,934 | 3/1975 | Mick | 123/119 A |
| 3,882,837 | 5/1975 | Horie et al. | 123/119 A |
| 3,931,813 | 1/1976 | Horie et al. | 123/119 A |
| 3,970,061 | 7/1976 | Caldwell | 123/119 A |
| 3,977,381 | 8/1976 | Fusikawa et al. | 123/119 A |
| Re. 27,993 | 4/1974 | Walker | 123/119 A |

FOREIGN PATENT DOCUMENTS

| | | | |
|---|---|---|---|
| 1,601,374 | 4/1970 | Germany | 123/119 A |
| 2,351,721 | 5/1974 | Germany | 123/119 A |

*Primary Examiner*—Wendell E. Burns

[57] ABSTRACT

Passage means communicating an EGR passage between first and second EGR control valves with a vacuum chamber of an actuator of the second EGR control valve is prevented from being clogged by solids of the engine exhaust gases by the provision of an air pump for feeding air to fill the passage means between an orifice therein and the EGR passage with air and to make the amount of engine exhaust gases passing through the orifice nearly zero.

4 Claims, 2 Drawing Figures

EXHAUST GAS RECIRCULATION SYSTEM

The present invention relates generally to an improvement in a system to feed exhaust gas into the intake passageway hereafter called an exhaust gas recirculation (EGR) system which is of a type comprising first and second EGR control valves disposed in series in an EGR passage and passage means providing communication between the EGR passage between the first and second EGR control valves and a vacuum chamber of a vacuum actuator of the second EGR control valve and particularly to an EGR system of this type which is improved to prevent the passage means from being clogged by solids in the engine exhaust gases passing therethrough.

As is well known in the art, internal combustion engines are equipped with exhaust gas recirculation (EGR) systems which feed exhaust gases of the engine into the intake passageways to lower the temperature of combustion of combustible mixtures in the engines and to reduce the production of nitrogen oxides (NOx) which pollute the atmosphere.

It is necessary that the amount of engine exhaust gases fed into the intake passageway is accurately controlled in due consideration of the stability of operation of the engine as well as reduction in the production of nitrogen oxides. For this purpose, the EGR system comprises an EGR control valve disposed in an EGR passage providing communication between the exhaust gas passageway and the intake passageway to meter the amount of engine exhaust gases fed into the intake passageway to a predetermined ratio to the amount of air drawn into the intake passageway. However, the EGR control valve cannot prevent the amount of engine exhaust gases metered thereby from being varied by the pressure differential of the parts of the EGR passage upstream and downstream of the EGR control valve. Thus, there is an EGR system of a type which comprises a second EGR control valve disposed in the EGR passage downstream of the first EGR control valve and serving to eliminate the above-mentioned inconvenience of the first control valve. The EGR system of this type is further provided with passage means for providing communication between a vacuum chamber of a vacuum actuator of the second EGR control valve and the EGR passage between the first and second EGR control valves to transmit the pressure in the EGR passage therebetween to the vacuum chamber. However, a prior art EGR system of this type has had a drawback that the passage means is clogged by engine exhaust gases passing therethrough and as a result the second EGR control valve is not satisfactorily operated. Thus, the prior art EGR system has failed to control the amount of engine exhaust gases fed into the intake passageway to an appropriate or desirable value.

It is, therefore, an object of the invention to provide an improved EGR system of the above-mentioned type in which the passage means is prevented, by the provision of an air pump to feed air into the passage means, from being clogged by engine exhaust gases.

This and other objects and advantages of the invention will become more apparent from the following detailed description taken in connection with the accompanying drawings in which.

Figure 1:
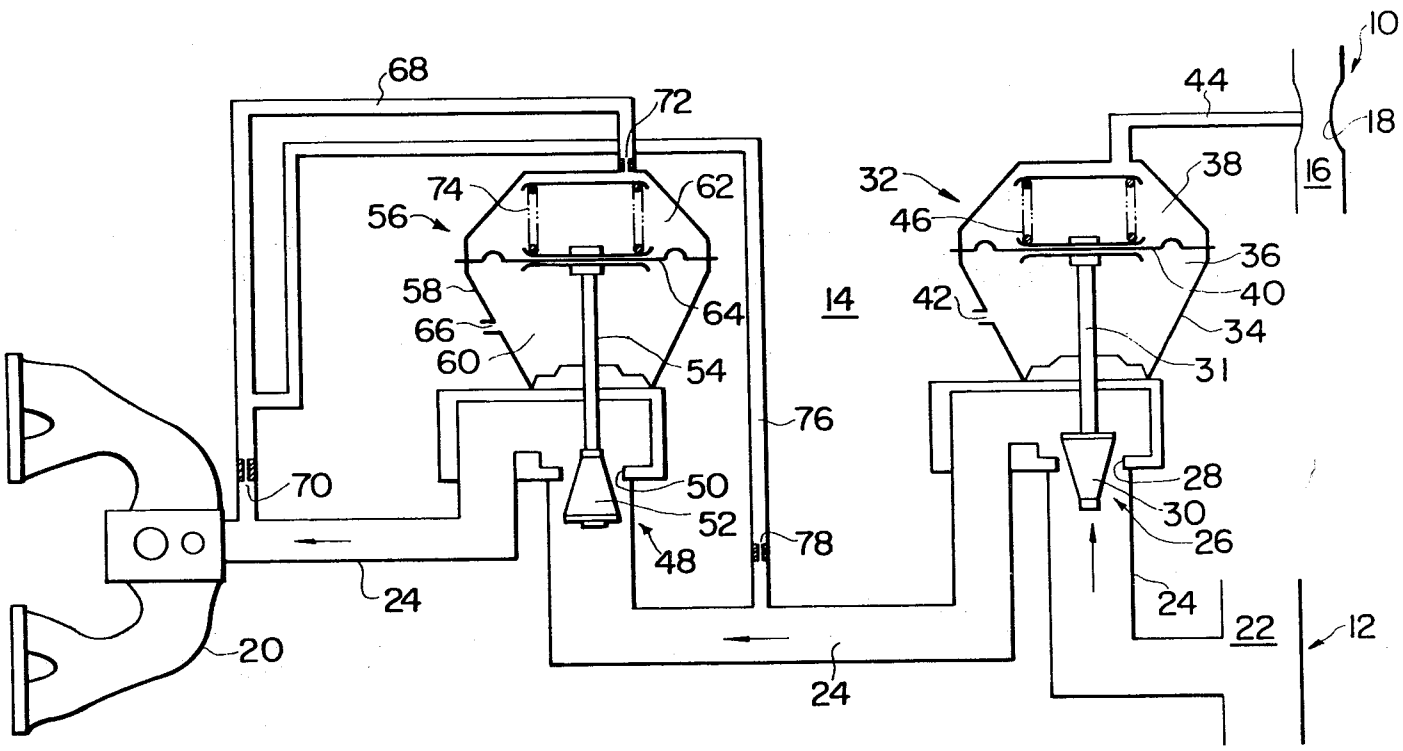
FIG. 1 PRIOR ART
FIG. 1 is a schematic cross sectional view of a prior art EGR system.

Referring to FIG. 1 of the drawings, there is shown intake and exhaust systems 10 and 12 of an internal combustion engine (not shown) and a prior art exhaust gas recirculation (EGR) system 14 which is combined with the intake and exhaust systems 10 and 12. The intake system 10 is shown to include an intake passageway 16 leading from the atmosphere to an intake port (not shown) of the engine having an intake manifold 20 forming a part of the intake passageway 16. The intake passageway 16 has a venturi or choke 18 formed therein and a throttle valve (not shown) rotatably mounted therein. The venturi 18 may be a venturi of a carburetor (not shown) of the engine. The exhaust system 12 is shown to include an exhaust gas passageway 22 leading from an exhaust port (not shown) of the engine to the atmosphere.

The EGR system 14 comprises an exhaust gas recirculation (EGR) passage or conduit 24 communicating at one end with the exhaust gas passageway 22 and at the other end with the intake manifold 20 or the intake passageway 16 downstream of the throttle valve and conducting exhaust gases of the engine into the intake passageway 16. A first exhaust gas recirculation (EGR) control valve 26 is disposed in the EGR passage 24 and includes a valve seat 28 formed in the EGR passage 24 and having the shape of, for example, an annular shoulder projecting thereinto, a valve head 30 movably located with respect to the valve seat 28 to vary the effective cross sectional area of the EGR passage 24 and having the shape of, for example, a cone, and a valve stem 31 extending from the valve head 30 externally of the EGR passage 24. A first vacuum actuator or servo 32 is provided to operate the first EGR control valve 26 and includes a housing 34 having therein first and second chambers 36 and 38, and a flexible diaphragm 40 separating the chambers 36 and 38 from each other. The first chamber 36 communicates with the atmosphere through an inlet port 42, while the second chamber 38 communicates with the venturi 18 in the intake passageway 16 through passage or conduit means 44. The diaphragm 40 is operatively connected to the valve stem 31 and is deformable in response to the vacuum in the chamber 38 to move the valve head 30 with respect to the valve seat 28 to vary the degree of opening of the first EGR control valve 26. The valve head 30 is arranged relative to the valve seat 28 to increase and reduce the degree of opening of the first EGR control valve 26 in response to an increase and a decrease in the vacuum in the chamber 38. A spring 46 is provided to urge the diaphragm 40 in a direction in which the degree of opening of the first EGR control valve 26 is reduced.

A second exhaust gas recirculation (EGR) control valve 48 is disposed in the EGR passage 24 downstream of the first EGR control valve 26. The second EGR control valve 48 serves to prevent the amount of the engine exhaust gases passing through the first EGR control valve 26 from being varied or affected by the difference between the pressures in the sections of the EGR passage 24 upstream and downstream of the first EGR control valve 26 which difference depends on the operating condition of the engine such as the load and speed thereof. The second EGR control valve 48 includes a valve seat 50 formed in the EGR passage 24 downstream of the first EGR control valve 26 and having the shape of, for example, an annular shoulder projecting into the EGR passage 24, a valve head 52 movably located with respect to the valve seat 50 to vary the effective cross sectional area of the EGR passage 24 and having the shape of, for example, a cone, and a valve stem 54 extending from the valve head 52 externally of the EGR passage 24. A second vacuum actuator or servo 56 is provided to operate the second EGR control valve 48 and includes a housing 58 having therein first and second chambers 60 and 62, and a flexible diaphragm 64 separating the chambers 60 and 62 from each other. The first chamber 60 communicates with the atmosphere through a port 66, while the second chamber 62 communicates with the EGR passage 24 adjacent to the intake manifold 20 through conduit or passage means 68. The conduit 68 may be connected to the intake manifold 20 so that the second chamber 62 directly communicates with the intake manifold 20. The conduit 68 has therein first and second orifices 70 and 72 formed at positions adjacent respectively to its ends. The diaphragm 64 is operatively connected to the valve stem 54 and is deformable in response to the vacuum in the second chamber 62 to move the valve head 52 with respect to the valve seat 50 to vary the degree of opening of the second EGR control valve 48. The valve head 52 is arranged relative to the valve seat 50 to reduce and increase the degree of opening of the second EGR control valve 48 in response to an increase and a decrease in the vacuum in the chamber 62. A spring 74 is provided to urge the diaphragm 64 in a direction in which the degree of opening of the second EGR control valve 48 is increased. Passage or conduit means 76 is provided to communicate at one end with the EGR passage 24 between the first and second EGR control valves 26 and 48 and at the other end with the conduit 68 between the first and second orifices 70 and 72 and has an orifice 78 formed at a position adjacent to the junction between the EGR passage 24 and the conduit 76.

The conventional EGR system 14 thus far described is operated as follows:

The second chamber 38 of the first vacuum actuator 32 is fed with the vacuum in the venturi 18 which vacuum is representative of the amount of air drawn into the intake passageway 16 during all operating conditions of the engine. The diaphragm 40 is moved into a position in which the difference between the pressure in the first chamber 36 and the vacuum in the second chamber 38 is balanced with the force of the spring 46. The diaphragm 40 moves the valve head 30 with respect to the valve seat 28 into a position corresponding to the position thereof so that the degree of opening of the first EGR control valve 26 is adjusted in accordance with the vacuum in the venturi 18. Accordingly, the first EGR control valve 26 controls or meters the flow of the engine exhaust gases passing therethrough to the second EGR control valve 48 to a predetermined ratio to the flow of air drawn into the engine.

The first EGR control valve 26 cannot prevent the flow of the engine exhaust gases passing therethrough from being varied in accordance with the pressure differential of the sections of the EGR passage 24 upstream and downstream of the first EGR control valve 26 when the degree of opening of the first EGR control valve 26 is at a certain value. Such an inconvenience of the first EGR control valve is eliminated by the second EGR control valve 48 as follows: The second chamber 62 of the second vacuum actuator 56 is fed through the conduit 68 with an intake passageway vacuum in the EGR passage 24 downstream of the second EGR control valve 48 or in the intake passageway 16 downstream of the throttle valve. The pressure in the EGR passage 24 between the first and second EGR control valves 26 and 48 is fed into the conduit 68 through the conduit 76 so as to eliminate or reduce the pressure differential of the sections of the EGR passage 24 upstream and downstream of the second EGR control valve 48. When the pressure differential of the portions of the EGR passage 24 downstream and upstream of the first EGR control valve 26 is increased, the pressure in the EGR passage 24 between the first and second EGR control valves 26 and 48 is reduced to increase the vacuum in the conduit 68 and accordingly the second chamber 62. As a result, the diaphragm 64 is moved by the pressure in the first chamber 60 overcoming the increased vacuum in the second chamber 62 and the force of the spring 74 to move the valve head 52 toward the valve seat 50. Accordingly, the degree of opening of the second EGR control valve 48 is reduced to increase the pressure in the EGR passage 24 between the first and second EGR control valves 26 and 48 to prevent the pressure differential of the portions of the EGR passage 24 upstream and downstream of the first EGR control valve 26 from being increased above a predetermined value. On the contrary, when the pressure differential of the sections of the EGR passage 24 downstream and upstream of the first EGR control valve 26 is reduced, the pressure in the EGR passage 24 between the first and second EGR control valves 26 and 48 is increased to reduce the vacuum in the conduit 68 and the second chamber 62. As a result, the diaphragm 64 is moved by the reduced vacuum in the second chamber 62 overcoming the pressure in the first chamber 60 and the force of the spring 74 to move the valve head 52 away from the valve seat 50. Accordingly, the degree of opening of the second EGR control valve 48 is increased to reduce the pressure in the EGR passage 24 between the first and second EGR control valves 26 and 48 to prevent the pressure differential of the portions of the EGR passage 24 upstream and downstream of the first EGR control valve 26 from being reduced below the predetermined value. Thus, the second EGR control valve 48 maintains the pressure in the EGR passage 24 between the first and second EGR control valves 26 and 48 or the pressure differential of the parts of the EGR passage 24 upstream and downstream of the second EGR control valve 48 and accordingly the pressure differential of the sections of the EGR passage 24 upstream and downstream of the first EGR control valve 26 at the predetermined value to make the amount of the engine exhaust gases fed into the intake passageway 16 through the EGR passage 24 independent of the difference between the pressure of the engine exhaust gases in the exhaust gas passageway 22 and the intake passageway or manifold vacuum. However, in the prior art EGR system 14, the conduit 76 or the orifice 78 is soiled and clogged by the engine exhaust gases passing therethrough with the lapse of time of use. This impedes the second EGR control valve 48 from being normally operated and accordingly makes it impossible for the first and second EGR control valves 26 and 48 to control the amount of the engine exhaust gases fed into the intake passageway 16 to a predetermined proper or desirable ratio to the amount of air drawn into the engine. If the diameter or cross sectional area of the orifice 78 is increased, the vacuum in the second chamber 62 is excessively reduced to make it impossible to normally operate the second EGR control valve 48. Thus, it is undesirable to increase the size of the orifice 78 or to omit the orifice 78.

Figure 2:
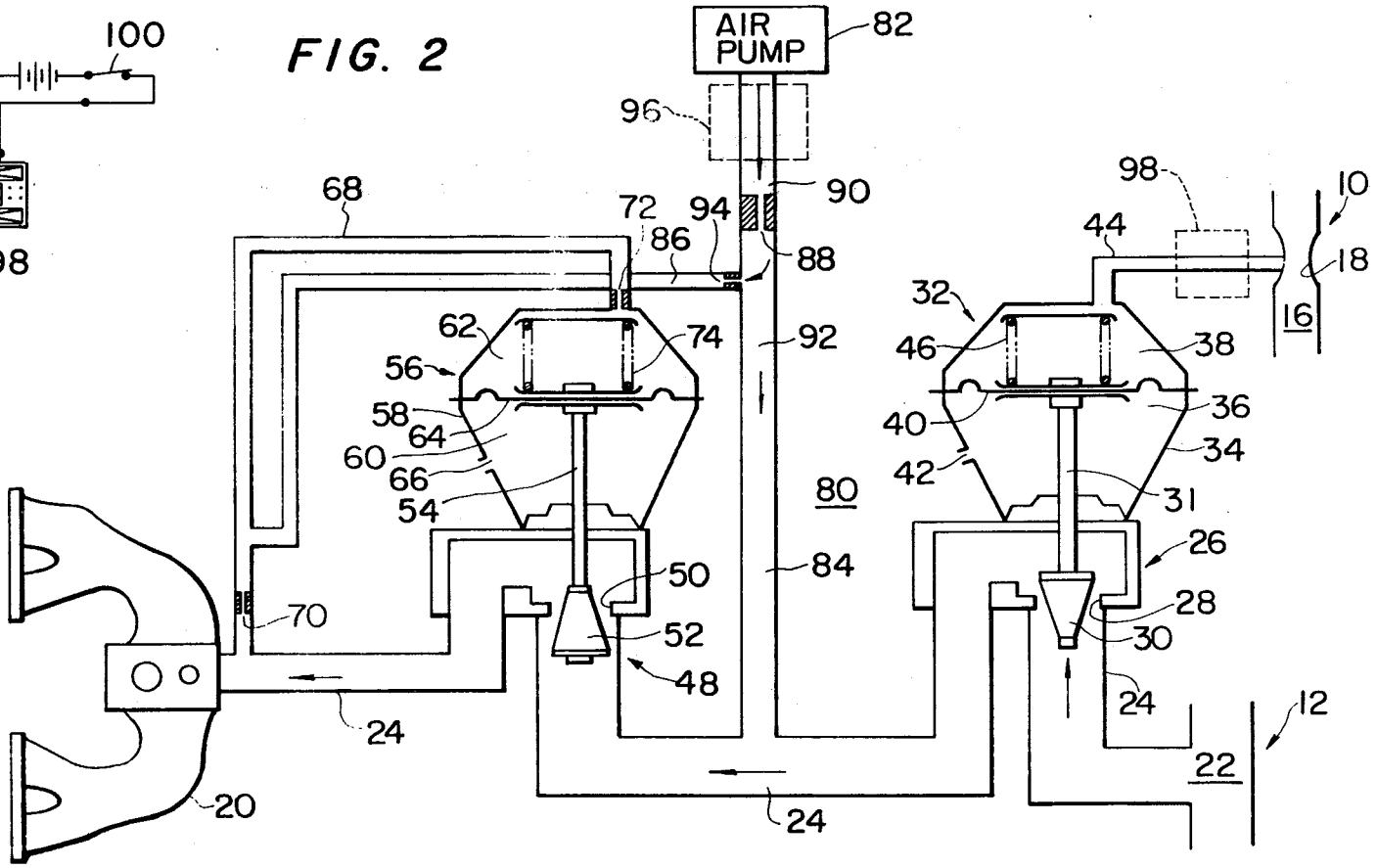
FIG. 2 is a schematic cross sectional view of a preferred embodiment of an EGR system according to the invention.

Referring to FIG. 2 of the drawings, there is shown intake and exhaust systems of an internal combustion engine (not shown) and a preferred embodiment of an improved exhaust gas recirculation (EGR) system according to the invention which is combined with the intake and exhaust systems. In FIG. 2, like component elements and parts are designated by the same reference numerals as those used in FIG. 1 and the description of the like component elements and parts is omitted for the purpose of simplicity. The improved EGR system, generally designated by the reference numeral 80, is characterized by the following aspects. The EGR system 80 comprises, in lieu of the confuit 76 of the EGR system 14 shown in FIG. 1, an air pump 82, first and second passage or conduit means 84 and 86. The first passage means 84 is formed therewith with an orifice 88 which divides the passage means 84 into upstream and downstream sections 90 and 92. The downstream section 92 communicates with the EGR passage 24 between first and second EGR control valves 26 and 48 and with one end of the second passage means 86. The second passage means 86 communicates at the other end with the conduit 68 between first and second orifices 70 and 72 and is formed therein with an orifice 94. The air pump 82 communicates with the upstream section 90 to feed air to fill the first passage means 84 with air to limit the amount of engine exhaust gases passing in the second passage means 86 or through the orifice 94 and to prevent the orifice 94 or the second passage means 86 from being soiled and clogged by solid particles of the engine exhaust gases. The first passage means 84 has a diameter or cross sectional area larger than that of the second passage means 86 and sufficient to minimize pressure drop or loss in the downstream section 92. The diameters or cross sectional areas of the orifices 88 and 94 are selected in such a manner that the orifice 88 permits air to pass therethrough which air is somewhat more than gas permitted to pass through the orifice 94 and has no influence on the air-fuel ratio of the air-fuel mixture burned in the engine.

The part of the EGR systme 80 thus far described is operated as follows:

The downstream part 92 of the conduit 84 is filled with fresh air discharged from the air pump 82 which air is metered by the orifice 88. Accordingly, only fresh air passes through the orifice 94 to the conduit 68 and exhaust gases of the engine are prevented from passing through the orifice 94 or the amount of engine exhaust gases passing through the orifice 94 is rendered nearly zero. As a result, the orifice 94 is prevented from being soiled and clogged by solids in engine exhaust gases. In this instance, since the part 92 of the conduit 84 is sufficiently large, the pressure in the EGR passage 24 between the first and second EGR control valves 26 and 48 is fed or transmitted into the conduit 68 so that the second EGR control valve 48 is normally operated by the second vacuum actuator 56.

Figure 3:
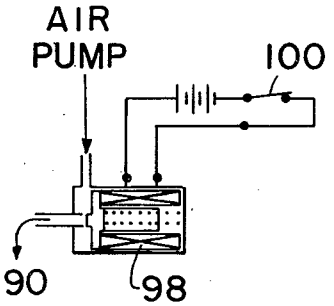

A control valve 96 may be provided in the upstream section 90 of the conduit 84 to normally permit air discharged from the air pump 82 to flow to the downstream section 92 of the conduit 84, and to prevent air from the air pump 82 from passing through the orifice 88 into the downstream part 92 to divert air from the air pump 82 into the atmosphere when a relatively small quantity of air is drawn into the engine as during such engine operating conditions as idling and deceleration. This is to prevent the air-fuel ratio of the air-fuel mixture of the engine from being undesirably increased by the air from the air pump 82 at such a time. By the way, since the first EGR control valve 26 is substantially fully closed to make the amount of the engine exhaust gases fed into the intake passageway 16 when the engine is in such operating conditions as idling and deceleration it is unnecessary to feed air from the air pump 82 into the downstream part 92 of the conduit 84. The control valve 96 may be, for example, a valve as shown in FIG. 3 which is electromagnetically operated by a solenoid 98 which is controlled in accordance with the degree of opening of an engine throttle valve (not shown) sensed by a throttle switch 100.

It is desirable that a pressure amplifier 98 is provided in the conduit 44 to rectify a relatively low vacuum from the venturi 18 into a relatively high vacuum which is fed to the vacuum chamber 38 of the first vacuum actuator 32.

The air pump 82 may be commonly employed as an air pump for feeding secondary air into the exhaust system 12 such as an exhaust manifold (not shown) to oxidize hydrocarbons (HC) and carbon monoxide (CO) contained in engine exhaust gases and to purify the same.

It will be appreciated that the invention provides an improved EGR system of a type comprising first and second EGR control valves disposed in series in the EGR passage and passage means communicating the EGR passage between the first and second EGR control valves with a vacuum chamber of an actuator of the second EGR control valve and formed therein with an orifice in which system the passage means is prevented from being clogged by solids in engine exhaust gases by the provision of an air pump for feeding air to fill the passage means between the EGR passage and the orifice with air and to make the amount of engine exhaust gases passing through the orifice nearly zero so that the first and second EGR control valves can precisely meter the amount of engine exhaust gases fed into the intake passageway to an appropriate ratio to the amount of air drawn into the engine throughout a long period of time to efficiently reduce the production of nitrogen oxides (NOx) and stabilize the operation of the engine.

What is claimed is:

1. An exhaust gas recirculation system for an internal combustion engine including an intake passageway having a throttle valve rotatably mounted therein, said system comprising an exhaust gas recirculation (EGR) passage for feeding exhaust gases of the engine into the intake passageway downstream of the throttle valve, a first exhaust gas recirculation (EGR) control valve disposed in said EGR passage, a first actuator operable in response to a vacuum representative of the amount of air drawn through the intake passageway to cause said first EGR control valve to meter the amount of the engine exhaust gases fed into the intake passageway to a predetermined ratio to the amount of said air, a second exhaust gas recirculation (EGR) control valve disposed in said EGR passage downstream of said first EGR control valve, a second actuator operable in response to the vacuum in the intake passageway downstream of the throttle valve and the pressure in said EGR passage between said first and second EGR control valves to cause said second EGR control valve to maintain the pressure differential of parts of said EGR passage upstream and downstream of said first EGR control valve at a predetermined value, passage means to communicate and EGR passage between said first and second EGR control valves with said second actuator, and control means for limiting the amount of the engine exhaust gases passing in said passage means to prevent said passage means from being clogged by the engine exhaust gases.

2. An exhaust gas recirculation system as claimed in claim 1, in which said passage means comprises a first passage having first and second sections and formed therein with an orifice separating said first and second sections from each other, said second section communicating with said EGR passage between said first and second EGR control valves, and a second passage communicating at one end with said second section of said first passage and at the other end with said second actuator and formed therein with an orifice and said control means comprises an air pump communicating with said first section of said first passage to feed air thereinto, said air pump filling said second section of said first passage with air to make the amount of engine exhaust gases passing through said orifice of said second passage nearly zero.

3. An exhaust gas recirculation system as claimed in claim 2, in which said first passage has a cross sectional area sufficient to minimize the pressure loss therein and said orifice of said first passage has a cross sectional area which is larger than that of said orifice of said second passage and permits air to pass which air is influenceless of the air-fuel ratio of the air-fuel mixture burned in the engine.

4. An exhaust gas recirculation system as claimed in claim 2, in which said control means further comprises a control valve disposed in said first section of said first passage and operable to normally permit air discharged from said air pump to flow to said second section and to, when a relatively small quantity of air is drawn into the intake passageway, prevent the air discharged from said air pump from flowing to said second section.

* * * * *